US005733662A

United States Patent [19]

Bogachek

[11] Patent Number: 5,733,662

[45] Date of Patent: Mar. 31, 1998

[54] METHOD FOR DEPOSITING A COATING ONTO A SUBSTRATE BY MEANS OF THERMAL SPRAYING AND AN APPARATUS FOR CARRYING OUT SAID METHOD

[75] Inventor: Valery Bogachek, Katzrin, Israel

[73] Assignee: Plas Plasma, Ltd., Israel

[21] Appl. No.: 534,031

[22] Filed: Sep. 26, 1995

[30] Foreign Application Priority Data

Sep. 26, 1994 [IL] Israel ..... 111063

[51] Int. Cl.[6] ..... C23C 4/12; B05C 5/04

[52] U.S. Cl. ..... 427/446; 239/79; 239/81; 219/76.16

[58] Field of Search ..... 427/446; 239/79, 239/81; 219/76.16, 76.14

[56] References Cited

U.S. PATENT DOCUMENTS

| | | | |
|---|---|---|---|
| 3,246,114 | 4/1966 | Matvay | 427/446 |
| 4,642,440 | 2/1987 | Schnackel et al. | 219/76.16 |
| 4,741,286 | 5/1988 | Itoh et al. | 427/446 |
| 4,818,837 | 4/1989 | Pfender | 427/446 |
| 5,233,153 | 8/1993 | Coats | 427/446 |
| 5,340,023 | 8/1994 | Itoh et al. | 427/446 |

FOREIGN PATENT DOCUMENTS 86303522 11/1986 European Pat. Off. .

OTHER PUBLICATIONS

Kadinov, V.V., "Plasma Coating", *Science*, pp. 16–17 (1977). (no monthdate).

*Primary Examiner*—Katherine A. Bareford

*Attorney, Agent, or Firm*—Wigman, Cohen, Leitner & Myers, P.C.

[57] ABSTRACT

Thermal spraying method and apparatus for depositing a coating onto a substrate by introducing material to be coated directly within the arc discharge area and by establishing a stable laminar plasma stream. By choosing particular parameters of the spraying method, namely electrical parameters and rate of ionizable fluid, required for establishment of plasma arc there is possible to enable efficient melting of material and conveying thereof toward the surface to be coated without spreading outside and before it is evacuated toward said substrate.

20 Claims, 3 Drawing Sheets

CU-NI X500

PHOTOMICROGRAPH OF COATING

METHOD FOR DEPOSITING A COATING ONTO A SUBSTRATE BY MEANS OF THERMAL SPRAYING AND AN APPARATUS FOR CARRYING OUT SAID METHOD

FIELD OF THE INVENTION

The present invention relates to the surface treatment technology, wherein melted metallic or non-metallic material is sprayed onto the surface to be treated, adheres thereto and forms a coating thereon.

More particularly, the present invention refers to the so-called thermal spraying technology, which can be briefly defined as follows. The material to be coated is sprayed towards the treated surface by virtue of a plasma stream, initiated by the plasma arc discharge ignited between cathode and anode within an atmosphere of an ionisable gas. The gas is continuously fed within the plasma arc discharge area, thus enabling maintenance therein of the plasma arc and formation of a plasma stream, emerging therefrom. The material to be coated is introduced within the plasma stream, is heated to its melting point or higher and is further carried away by the plasma effluent towards the surface to be treated.

The present invention relates both to a new method of coating which employs plasma thermal spraying, and to a new apparatus which was developed for the implementation of said method.

BACKGROUND OF THE INVENTION.

The above mentioned method of thermal plasma spraying is well known and theoretical fundamentals thereof are presented in numerous publications, for example in the monograph "Plasma coatings", by V. V. Kudinov, edition Nauka, 1977.

One of the typical features inherent to know thermal plasma spraying methods is the utilisation of a high velocity turbulent plasma stream, which emerges from the arc discharge area and conveys the melted material towards the treated surface. Employing of the turbulent plasma stream is accompanied by a number of undesirable consequences, e.g.,

- too large spread angle of plasma effluent (up to 30 degrees), resulting in inefficient utilisation of coating material;
- intake of surrounding cold air within the plasma stream, causing rapid cooling and shortening of useful presence of material within the stream, when it is still hot;
- undesirable intensive oxidation and inhomogeneous heating of the material within the stream, resulting in interior adhesion and poor quality of coating.

In order to minimise the negative influence of the above mentioned consequences on a coating quality, it is known in the art to increase plasma power up to 200 kw and to accelerate plasma stream up to velocities in the range of 0.53 Mach.

Unfortunately, plasma effluent propagating with such high velocities produces very significant noise (100–130 decibels). Therefore, this measure is inevitably associated with the necessity to enclose the entire plasma spray apparatus in a special bulky sound protecting chamber, thus making the method inconvenient to operate.

Moreover, the powerful plasma stream can be detrimental for small parts, especially for those having thin walls, and is therefore unsuitable for depositing coatings thereon.

The alternative approach is based on the establishment of a laminar plasma stream for conveying the melted material towards the substrate. The advantage of the laminar plasma stream lies in more efficient melting of coating material, increased length of plasma effluent (100–700 mm compared with 50 mm for turbulent stream), and reduced spread angle (1–3 degrees).

However, to achieve, in practice, an efficient laminar plasma stream consisting of 2 phases (plasma effluent and coating material) is a difficult engineering task. Numerous attempts have been made to resolve it.

One approach commonly used for this purpose is based on employing a vacuum or reduced pressure for formation of the laminar plasma stream (the so-called dynamic vacuum deposition method). Unfortunately, implementation of this measure is associated with the necessity of a special hermetic chamber, required for maintaining a vacuum or low pressure environment. It can be readily appreciated that such an approach could suffer from the same drawbacks as the already mentioned enclosing of the spray apparatus within a sound protecting chamber.

The other approach for ensuring laminarity of the plasma effluent is based on the employment of auxiliary devices, retrofitted within the plasma spray apparatus and deliberately designed so as to be capable of imparting a laminar character to the plasma stream emerging therefrom.

An example of such an approach can be found in EP202077, assigned to the Onoda Cement Company.

In this reference an apparatus is described for thermal plasma spraying, which is provided with a dedicated rectifying device, mounted between the tip of the cathode and an inlet port through which ionisable gas is fed into the apparatus. The rectifying device employed in this apparatus serves as a resistance, reducing the velocity of gas supplied to the arc discharge area.

By virtue of the reduced gas velocity a laminar plasma stream is created and in order to maintain its laminarity along the entire stream length a refractory protecting sheath is arranged, extending coaxially with the stream. Provision of a protecting sheath prevents spreading of the melted material aside from the stream. The sheath is also provided with inlet and outlet ports for blowing therein of a coolant gas. The plasma spray apparatus, described in the above reference has sophisticated construction; its proper functioning depends on proper adjustment of the velocity of the main and additional gases, to be carried out before running the process.

Another disadvantage of this apparatus is associated with the fact that those particles of material to be deposited, which are in close contact with the protecting sheath may adhere thereto, causing instability of the plasma stream and even may block the interior of the sheath and interrupt the process. One can assume, that in order to prevent this situation the process should be periodically terminated for inspection and cleaning.

A further disadvantage of this apparatus is associated with the fact that its anode is formed as a conical member, radially surrounding the outer circumference of a cathode tip. By virtue of this construction a closed space is provided between cathode and anode, in which the plasma arc is ignited. The disadvantage inherent to this construction is that the deposited material cannot be directly introduced into the arc discharge area, which has the most favorable thermal conditions for melting. Instead, this coating material is heated within the plasma stream, where the intensity of heat transfer is much less.

Another disadvantage of the closed arc discharge area is associated with severe wear of the anode, shortening its service life.

In conclusion it should be pointed out, that despite the fact that many different thermal spraying apparatuses are known which produce a laminar plasma stream, there still exists a demand for a new, simple, convenient-to-maintain and efficient-in-service device.

OBJECT OF THE INVENTION

The object of the present invention is to provide a plasma spray method and an apparatus for its implementation, in which the above mentioned drawbacks of known plasma spray devices are sufficiently reduced or overcome, without, however, losing their inherent benefits.

In particular, the first object of the present invention is to provide a new, simple and efficient thermal spray coating method and apparatus for its implementation, in which the efficiency of spraying is improved by introducing material directly within the arc discharge area and by creation of a stable laminar plasma stream, capable of conveying this material towards the surface to be coated without spreading outside.

Another object of the present invention is to provide a new thermal spray apparatus, which is convenient to maintain and has improved efficiency due to prolonged anode service life.

Still, a further object of the present invention is to provide an improved, simply constructed, thermal plasma spray apparatus, which enables utilisation of commercially available equipment, e.g. a plasma welding apparatus.

The above and other objects and advantages of the present invention can be achieved in accordance with the following combination of its essential features, referring to different embodiments thereof.

A method of depositing of a coating onto a substrate by means of thermal spraying of a coating, wherein a primary plasma arc is ignited between a cathode and an anode and is accompanied by the formation of a substantial laminar plasma stream directed towards said substrate and wherein material to be coated is carried away by said stream towards said substrate, solidifying thereon and adhering thereto.

This method comprises the following main steps:

establishing between said cathode and anode of an atmosphere of a first ionisable fluid, enabling ignition of said primary plasma arc and establishing of said stream, supplying to said cathode and anode electrical power, sufficient for passing therebetween of an arc-forming current, capable of igniting said primary plasma arc.

In accordance with the present invention the method also includes the following additional steps:

introducing said material directly within space region, defined by said primary plasma arc so as to enable efficient melting of said material therein before it is evacuated by said stream towards said substrate, and supplying of said first fluid into said region at a controllable rate, chosen in a range of 0.1–10 liter per min, preferably being 0.2–3.0 liter per min so as to impart to said plasma stream laminar character, defined by a linear velocity not more than 50 m per sec, preferably being 15–30 m per sec.

In accordance with one of the preferred embodiments of the present method it includes maintaining an auxiliary arc discharge, capable of ionising said first fluid so as to assist initiation and maintaining of said primary plasma arc.

According to another embodiment of this method, said first fluid is chosen from a groups which includes an inert gas or a mixture thereof with other gases.

As per still a further embodiment said method includes supplying of a second fluid to said anode so as to protect thereof from excessive wear and to enable control of a cross-sectional configuration of said primary plasma arc and said stream.

In a still further preferred embodiment said first and second fluids are supplied coaxially with said cathode.

According to mother embodiment of said method the magnitude of electrical current, chosen for initiation of said primary plasma arc should not exceed 100 amperes, preferably being 20–70 amperes; the magnitude of electrical current chosen for igniting said auxiliary arc does not exceed 10 amperes, preferably being 4–8 amperes.

In a still further embodiment said coating material is introduced within the primary plasma arc region preferably in a comminuted form in the amount of 5–30 g/min.

According to one of the preferred embodiments relating to implementation of the present invention, as an apparatus it comprises a cathode and an anode, a main power supply source, sufficient for igniting and maintaining the primary plasma arc in a space region therebetween, a means for conveying of a first ionisable fluid towards said region so as to establish a laminar plasma stream, emerging therefrom towards said substrate, means for introducing the coating material substantially within the primary plasma arc region, so as to enable melting of this material therein and evacuation thereof by said plasma stream towards said substrate, said means for conveying of a first ionisable fluid is formed as an elongated tubular member, having distal and proximal extremities, while the distal extremity thereof is provided with an inlet opening, communicating with a source of said fluid; the proximal extremity thereof is provided with an outlet orifice, communicating with primary plasma arc region, and the inwardly facing surface of said tubular member surrounds said cathode so as to provide annular passage therebetween, sufficient for passing of said first fluid therethrough:

said anode is formed as a flat member, with its plane directed substantially perpendicular to said cathode, said means for introducing of coating material is located adjacent to said primary plasma arc region, so as to enable introduction of said material therein.

In one of the preferred embodiments of said apparatus the diameter of said outlet orifice is chosen in a range of 0.5–5 mm, preferably being 1.0–3.0 mm so as to enable emerging of said first fluid therefrom at a controllable rate of 0.1–10 liter per min, preferably being 0.23 liter per min.

In another preferred embodiment said tubular member is electrically connected with an auxiliary power supply source so as to maintain the spark discharge between said cathode and said outlet orifice.

In another preferred embodiment said apparatus is provided with an anode cooling means and with an anode displacement means, enabling to vary the location of said anode with respect to said primary plasma arc.

In accordance with still a further embodiment of said apparatus it is provided with a means for supplying a second fluid between the cathode and anode.

As per yet another preferred embodiment, said means for supplying of a second fluid is formed as a sleeve provided with a protecting nozzle, surrounding at least part of the outwardly facing surface of said tubular member so as to be in coaxial disposition there with and to provide a passage space therebetween, said sleeve having an inlet opening for communicating with a source of said second fluid and said nozzle having an outlet opening for communication with the primary plasma arc region so as to enable supply of said second fluid thereto.

DETAILED DESCRIPTION OF SPECIFIC EMBODIMENTS

Figure 1A:
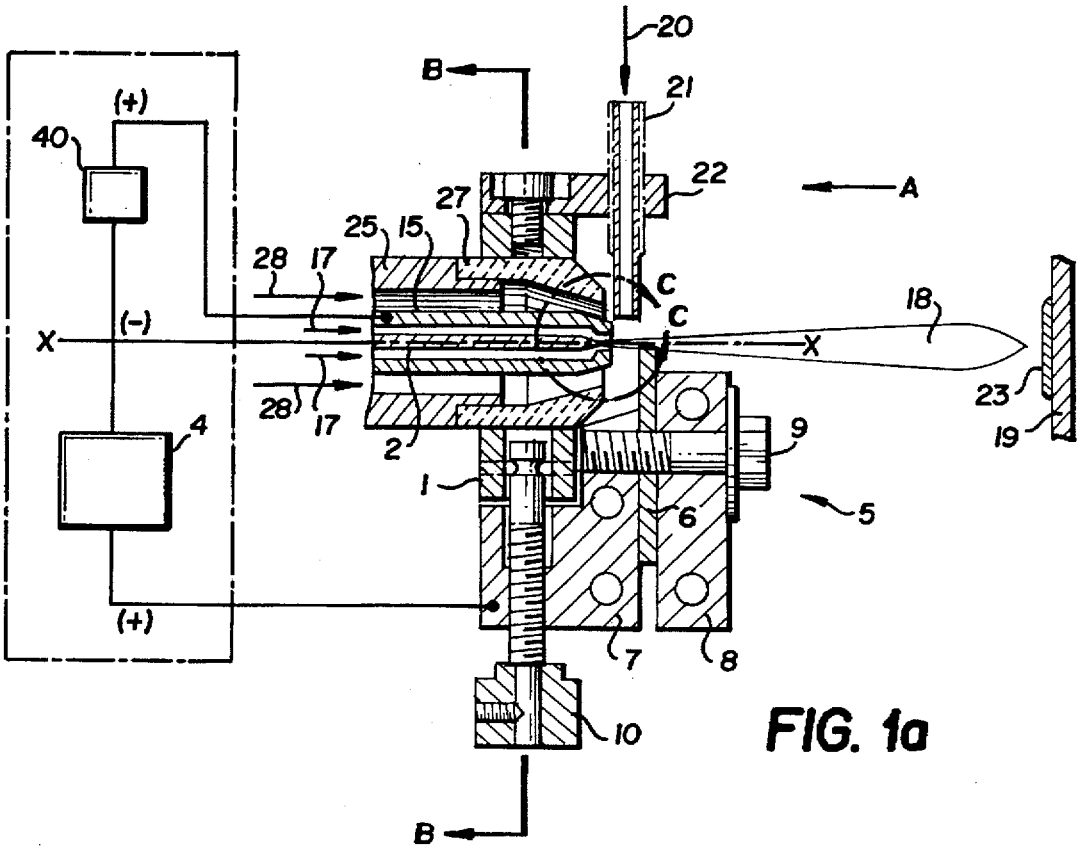
FIG. 1*a* shows a side view of an apparatus for thermal plasma spraying in accordance with the present invention.

Referring to FIG. 1*a* an apparatus for the deposition of a material onto a substrate by the thermal spraying method in accordance with the present invention will be described.

This apparatus comprises a body (not shown), on a mounting plate 1 of which cathode 2 is secured, preferably formed as an elongated rod, terminating at the tip portion 3 and extending longitudinally along the horizontal axis X—X. The cathode is electrically connected with a negative terminal of the main power source 4. Anode assembly 5 is attached to the mounting plate 1 and comprises an anode, formed as a flat washer 6, situated between two cooling plates 7,8. The anode and cooling plates are held together by a mounting bolt 9 and the whole assembly is arranged on the mounting plate 1 with the possibility of being controllably displaced along sliding bars 11,12 in a direction, perpendicular to axis X—X (see FIGS. 2,3). Displacement of the anode assembly can be effected by means of adjustment screw 10.

Cooling plates 7,8 are formed with appropriate inlet and outlet ports 13,14 for cooling liquid (not shown), circulating therein during operation so as to effect cooling of the anode washer.

Figure 1B:
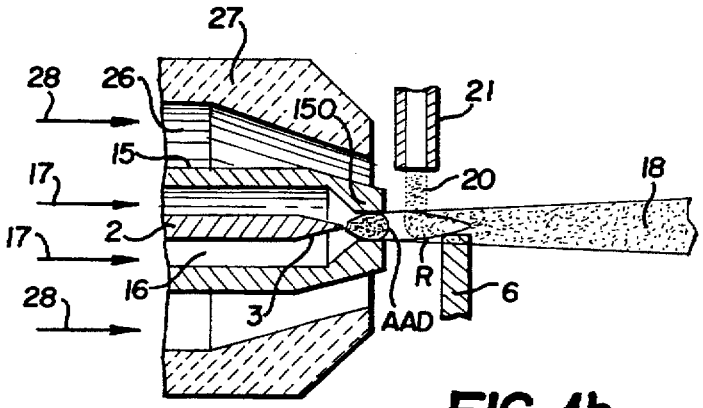
FIG. 1*b* shows an enlarged fragment C of FIG. 1*a*.

The anode assembly is connected with a positive terminal of the main power source 4 so as to enable the applying of a voltage to cathode 2 and anode washer 6 and the passing of a current substantially in a space region between cathode tip 3 and adjacent portion of anode washer 6. With reference to FIG. 1*b* this region is designated as R.

The elongated tubular member 15 is secured on mounting plate I so as to extend coaxially with the cathode and to provide an annular passage 16, defined by the inwardly facing surface of the tubular member 15 and the outwardly facing surface of the cathode rod 2. That extremity of tubular member 15, which is proximal to the cathode tip 3 is provided with an outlet orifice 150, enabling direct communication of the annular passage 16 with the space region R. The diameter of the orifice opening is D. It will be explained later how this diameter should be chosen in accordance with the present invention so as to ensure the most advantageous performance of the apparatus.

The opposite distal extremity of the tubular member 15 is connected with the positive terminal of the main power source and is provided with an inlet port (not shown) for connection with a source of the pressurized first ionisable fluid 17. The fluid is urged by virtue of pressure to pass via the annular passage 16 and to emerge therefrom via the opening in the outlet orifice 150 towards the space region R.

As suitable fluid one can use gas chosen from a group, including nitrogen, argon, helium, hydrogen or any other gas, capable of being ionised when an electrical current passes between the cathode and tubular member and the magnitude of this current is sufficient to ignite an arc discharge between cathode tip and outlet orifice. This discharge will be referred to further as the auxiliary arc discharge and it is designated in FIG. 1*b* as AAD. In practice argon or a mixture thereof with other gases is commonly used as the appropriate fluid medium. In accordance with the present invention it is advantageous if auxiliary arc discharge is maintained continuously. For this purpose a dedicated auxiliary power supply 40, equipped with high voltage oscillator can be used. It should be realised, that the auxiliary power supply source can also be formed as a built-in unit, integrated within the main power supply source 4.

In practice the auxiliary power supply 40, used for igniting and maintaining the auxiliary arc discharge should be capable of providing electrical current, not more that 15 amperes, preferably being 4–8 amperes.

After the auxiliary arc discharge has been established, electrical power is supplied by the main power source to the anode and cathode and electrical current passes therebetween. This current should be sufficient to initiate a primary plasma arc substantially in a region R between the cathode and anode. With reference to FIG. 1*b*, which shows this region in more detail, it can be seen how the auxiliary arc discharge and primary plasma arc are situated with respect to the cathode and anode. It can be seen that the auxiliary arc discharge is concentrated substantially within the outlet orifice in proximity to cathode tip 3, while the primary plasma arc extends along the space region R between the cathode tip and the anode.

By virtue of ionisable fluid 17, continuously fed into the tubular member 15 and emerging from orifice opening the ionised environment is maintained within space region R.

In accordance with the present invention the rate and pressure of fluid 17 is chosen so as to be sufficient not only to maintain this environment but also to create a plasma stream or effluent 18, emerging from the primary plasma arc region R towards the substrate 19, to be coated.

Maintaining of the spark discharge by means of an auxiliary power supply is associated with the continuous ionisation of a first fluid, which assists in generating the primary plasma arc and allows employment of relatively small power sources with the capability to supplying current not more than 100 amperes. The additional positive effect, associated with maintaining the auxiliary spark discharge is improving the stability of the primary plasma arc and the possibility of achieving higher current densities. These are some of the advantages of the present invention, compared to known plasma spraying methods, in which the plasma arc is initiated and maintained without employing auxiliary power supply.

According to the invention the heat fusible material 20 is fed directly into region R, where the primary plasma arc has been initiated.

To introduce the coating material into region R tube 21, which has an inner diameter d, is provided. The tube is secured by bracket 22 on mounting plate 1. In practice, the material to be coated is introduced into the primary plasma arc after this material has been ground, milled or comminuted by any other suitable technique so as to enable its free passage via tube 21.

It has been empirically found that by virtue of introducing of the coating material directly into the primary plasma arc it was possible effectively melt even materials with relatively high melting point, e.g Mo, Al2O3, while still utilising relatively low currents in a range of 40–80 amperes. The coating material, introduced into the primary plasma arc is effectively heated therein, melted thereby and then evacuated therefrom by virtue of the plasma stream 18 towards the substrate 19, where it rapidly solidifies and adheres with the formation of a coating 23.

It might be advantageous to secure tube 21 within bracket 22 with possibility of being slidably displaced in a direction, perpendicular to axis X—X so as to enable adjustment of the location where the material enters the into plasma arc.

It is not shown specifically, but should be understood, that an appropriate control means is provided for variation of electrical parameters of the main and auxiliary power supply sources and of the rate of gas emerging from the outlet orifice.

By choosing the electrical parameters and by adjusting the location of tube 21 within bracket 22, one can create primary plasma arc which is most suitable for heating and melting of a wide range of coating materials without their evaporation or decomposition.

In accordance with the present invention the cathode assembly is provided with hollow protecting sleeve 25, having an inside diameter, exceeding the outside diameter of the tubular member The sleeve 25 is arranged coaxially with the tubular member 15 and extends therealong, so as to define an elongated passage 26 therebetween, having an annular cross-sectional configuration. That extremity of the protecting sleeve 25, which is proximal to the outlet orifice of the tubular member 15 is provided with nozzle 27, having an outlet opening for communication with space region R. Nozzle 27 is releasable and secured onto the mounting plate 1 by means of a clamping screw 24.

In practice nozzle 27 is made of a refractory material, capable of withstanding high temperatures, associated with maintaining spark discharge and primary plasma arc.

The opposite proximal extremity of sleeve 25 is connected with a suitable pressurized source (not shown) of a second fluid 28, which is continuously fed within passage 26. As a suitable fluid one can employ the same gases, as for the first fluid, e.g. argon, helium, hydrogen or the like. In practice argon is the most commonly used gas.

By virtue of pressure the second fluid is urged to emerge from nozzle outlet opening towards space region R, where the coating material is introduced and plasma arc is generated and maintained. The purpose of second fluid is twofold. It serves as a protecting medium, preventing excessive oxidation of coating material during its melting and, on the other hand, it stabilizes the primary plasma arc and enables control of its cross-sectional configuration.

Construction of the anode assembly, employed in the apparatus in accordance with present invention will now be explained in more detail. The assembly comprises an anode plate, preferably formed as a flat washer 6, having a round configuration.

That portion of the anode plate, which, during operation is situated adjacent to the plasma arc region R, undergoes rather severe wear and should be periodically replaced by the still unworn portions thereof. This measure should be performed timely since excessive wear may cause termination of the whole process. In order to facilitate service conditions and to enable periodical introduction of fresh unworn anode portions the anode plate is mounted between two cooling plates 7,8 with the possibility of being rotated when mounting bolt 9 is released.

It can be realised, that replacement of the mode portions is an easy and convenient maintenance operation, which is not associated with interruption in circulation of the cooling liquid within plates 7,8.

Instead of the round configuration, the anode washer can be defined by a polygonal configuration, for example rectangular, triangular, etc. It can be readily appreciated, that by virtue its flat surface it will be still possible to rotate such an anode and to introduce unworn portions thereof into operation.

Figure 2:
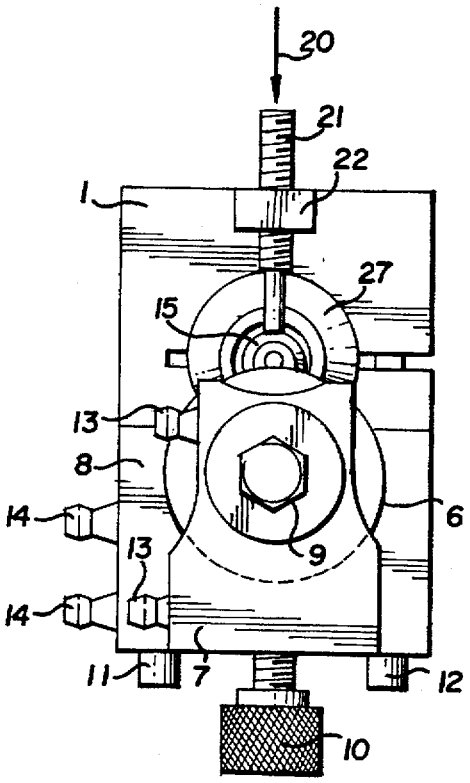
FIG. 2 is a front view of an apparatus in accordance with the present invention.
Figure 3:
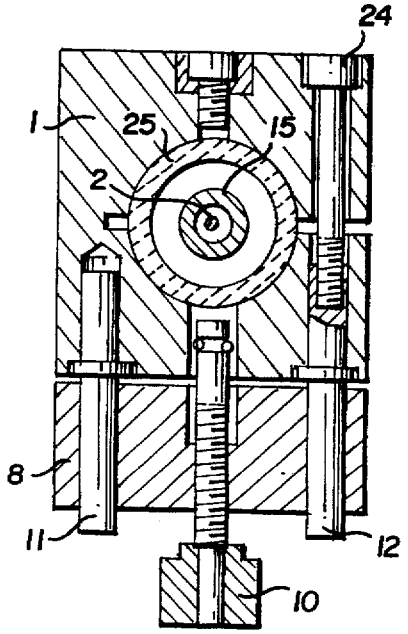
FIG. 3 is a cross-section of FIG. 2, taken along line B—B.
Figure 4:
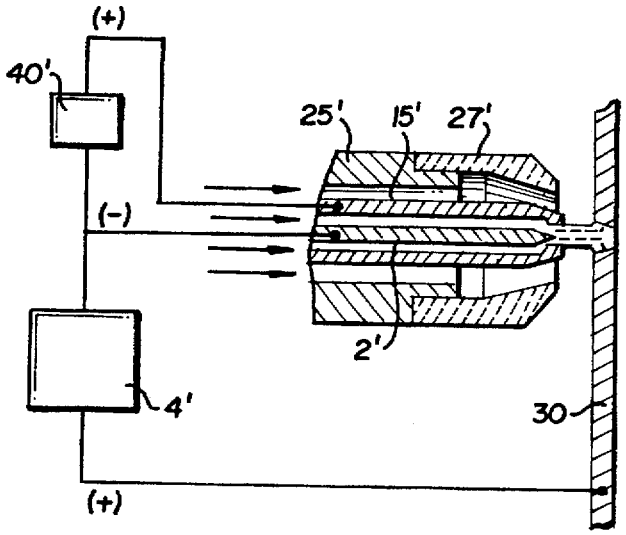
FIG. 4 schematically shows the main components of the plasma spraying apparatus in accordance with the present invention, constituting a commercially available plasma welding setup.

The above described construction of the apparatus is very simple and, in accordance with the present invention, it can be advantageously implemented by utilisation of a commercially available plasma welding setup. This setup is schematically shown in FIG. 4 and one can see that its major parts, including cathode 2', main and auxiliary power supply sources 4',40', gas introducing means 15', protecting sleeve 25' and nozzle 27' are similar to those, required for the plasma spray apparatus. The setup serves for generation of the plasma stream P between cathode 2' and plate 30, constituting the anode. By virtue of the plasma stream emerging from nozzle 27', welding of plate 30 is effected. It can be readily appreciated, that by simple replacement of plate 30 into anode assembly, as shown in FIGS. 1–3 and by retrofitting of material introducing means this plasma welding setup can be easily converted into a plasma spray coating apparatus.

It has been found, that when some technological parameters of the present method and the constructional parameters of implementing the apparatus are chosen in accordance with the present invention, one can achieve a very laminar plasma stream, emerging from the primary plasma arc region R.

This stream is defined by a velocity not exceeding 50 m/sec preferably being 15–30 m/sec and by Reynolds number Re=0.12–0.55. The known relationship to calculate the Reynolds number, $0.11 \leq M\sqrt{Re} \leq 0{,}22$, as used (see Polak and Surov, Investigation of powder particles within plasma stream, Chemistry of Materials Treatment, 2, 1969, pp. 19–29).

Achieving such a laminar plasma stream is associated with reduced spreading of coating material, more efficient utilisation thereof and allows to deposit coatings on small parts.

In practice constructional parameters of the above described apparatus should be chosen as follows:

The diameter D of the outlet orifice opening should exceed the diameter d of the material introducing tube 21 by at least a factor of 1.5.

The diameter D of the outlet orifice 150 should be 0.5–5 mm, preferably being 1.0–3.0 mm.

The first fluid should be supplied within tubular member 15 with rate 0.1–10 l/min, preferably being 0,2–3 l/min.

The primary plasma arc generating current supplied by the main power source 4 should not be more than 100 amperes, preferably being 20–70 amperes.

The coating material should be introduced into the primary plasma arc region R with output up to 30 g/min, preferably being 8–20 g/min.

It should be pointed out that, if the D/d ratio chosen is less than 1.5 or diameter D is less than 1 mm, it is difficult to introduce commercially available powdered coating materials into the plasma arc region, and the whole deposition process becomes instable.

On the other hand, if diameter D is more than 3 mm the laminar character of the plasma stream can be ensured only by significant increase of the plasma generating current and of the rate of the first fluid. These measures are undesirable, seeing that they make the whole process uneconomical.

If the first fluid is fed at less than 0.1 l/min, the plasma stream becomes instable. If however this rate is more than 10 l/min, it is no longer possible to maintain the laminar plasma stream and it becomes turbulent.

Empirically, it has been established that the most suitable range for the first fluid supply rate lies between 0.2 and 3 l/min.

Figure 5:
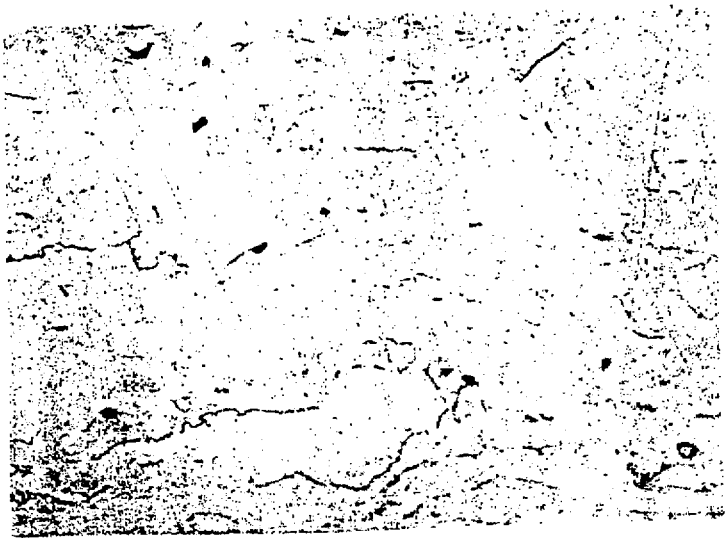
FIG. 5 presents a photomicrograph with an example of the microstructure of a coating deposited in accordance with the present invention.

With reference to the non-limiting example 1, table 1 and FIG. 5 it will be shown how the present invention was implemented to deposit a metallic coating onto a stainless steel substrate.

EXAMPLE 1

Substrate: rotating stainless steel rod, having a diameter 18 mm

Rotation speed: 600 rpm

Diameter D of the outlet orifice: 1.5 mm

Coating material: commercially available Cu—Ni alloy powder.

First ionisable fluid: Argon gas

Protecting gas: Argon

Auxiliary arc discharge current: 6 amperes

Reynolds number of plasma stream, emerging from primary arc region: 0.14

Deposition parameters and properties of obtained coatings are summarised in table 1 below.

TABLE 1

| Coating material powder, its size and feed rate | Primary arc current, amp | Voltage v | Rate of first fluid, l/min | Rate of protecting gas l/min | Distance between substrate and outlet orifice, mm | Adhesion to substrate MPa * |
|---|---|---|---|---|---|---|
| Cu—Ni alloy Metco 57NS 40–100 micron 12 g/min | 35 | 30 | 0.9 | 2.2 | 90 | 68 |

* Adhesion has been evaluated as tensile bond strength in accordance with the Pratt ad Whitney specification PWA 53, "Coating, Plasma Spray Deposition".

Examination of the microstructure of the obtained coating, shown in FIG. 5 allows to conclude that it meets the requirements of the above mentioned specification, PWA 53, i.e., it is defined by uniform distribution of its constituents, it is free of cracks, massive porosity and excessive oxides, it is free of inclusions and contaminations at the coating-basis interface.

By virtue of the above listed parameters in combination with direct introduction of coating material into the primary arc region the following advantages are achieved:

thermal energy of plasma arc is utilised more effectively the coating material melts mostly without oxidation and forms a coating, having a microstructure, which meets the appropriate requirements there is no need for powerful power supply sources the service life of cathode and anode assemblies is improved it is possible to deposit coatings on small parts having a wall thickness up to 0.1 mm resolution of plasma spot can be effectively controlled and maintained within 3–4 mm efficiency of utilisation of coating material is not less than 0.8 noise level does not exceed 30 Db; thus, there is no need for sound protecting measures.

efficient coating is possible by means of simple, compact and convenient apparatus.

The present invention should not be limited to the above embodiments. It should be realised that changes and modifications can be made by one ordinary skilled in the art, without deviation of the scope of the invention, as will be defined below in the appended claims.

At the same time it should be understood, that features, disclosed in the foregoing description, in the following claims and/or accompanying drawings, and/or examples may separately and in any combination thereof, be material for realizing the present invention in diverse forms thereof.

I claim:

1. A method for depositing a coating onto a substrate by means of thermal spraying of a coating material, wherein a primary plasma arc is initiated between a cathode and an anode and is accompanied by the formation of a substantially laminar plasma stream, and wherein said stream is directed toward said substrate and the coating material is carried by said stream toward said substrate so as to enable solidification thereof with subsequent formation of a coating;

said method comprising the steps of:

establishing, in a region between said cathode and said anode, an atmosphere of a first ionisable fluid, required for initiation of said primary plasma arc in said region and for establishment of said plasma stream, igniting and maintaining an auxiliary arc discharge which is capable of ionizing said first fluid so as to assist in the initiation and maintaining of said primary plasma arc, and supplying, to said cathode and said anode, electrical power sufficient for the passing therebetween of an arc-forming current, resulting in the initiation of said primary plasma arc in said region;

wherein said coating material is introduced substantially directly into said region wherein said primary plasma arc is initiated, so as to enable melting of said coating material therein before it is evacuated by said stream toward said substrate, and said first fluid is supplied at a controllable rate, chosen in a range of 0.1–10 liter per minute, so as to achieve the establishment of the laminar plasma stream defined by a linear velocity not more than 50 m/sec.

2. A method as defined in claim 1, wherein said first fluid comprises an inert gas.

3. A method as defined in claim 2, wherein said first fluid comprises an inert gas mixed with at least one other gas.

4. A method as defined in claim 2, wherein said inert gas comprises argon.

5. A method as defined in claim 4, further comprising the step of supplying a second fluid to said anode so as to protect said anode from excessive wear and to enable control of the cross-sectional configuration of said primary plasma arc and of said plasma stream.

6. A method as defined in claim 5, wherein said second fluid comprises an inert gas.

7. A method as defined in claim 6, where said second fluid comprises an inert gas mixed with at least one other gas.

8. A method as defined in claim 1, wherein the magnitude of the arc forming electrical current required for the initiation of said primary plasma arc does not exceed 100 amperes.

9. A method as defined in claim 1, wherein the magnitude of the electrical current required for maintaining of the auxiliary arc discharge does not exceed 15 amperes.

10. A method as defined in claim 1, wherein said coating material is introduced within said primary plasma arc in a comminuted form in an amount not more than 30 g/min.

11. A method as defined in claim 1, wherein said auxiliary arc discharge is ignited and maintained substantially between said cathode and an outlet orifice through which said laminar plasma stream passes as it enters said region.

12. An apparatus for depositing a coating onto a substrate by thermal spraying of a coating material to be deposited, said apparatus comprising:

a cathode and an anode defining a space region therebetween;

a main power supply source capable of supplying electrical power sufficient for the initiation of a primary plasma arc and maintaining said primary plasma arc in said space region between said cathode and said anode; and means for conveying a first fluid toward said space region so as to establish a laminar plasma stream emerging therefrom toward said substrate;

wherein said means for conveying a first fluid comprises an elongated tubular member having distal and proximal extremities, said distal extremity being provided with an inlet opening communicating with a source of said first fluid and said proximal extremity being provided with an outlet orifice communicating with said space region, wherein an inwardly facing surface of said tubular member surrounds said cathode so as to provide a passage therebetween sufficient for passing of said first fluid therethrough;

said apparatus further comprising means for introducing said coating material directly into said space region so as to enable melting of said coating material therein with subsequent evacuation toward said substrate;

wherein said anode comprises a substantially flat member, having its surface directed substantially perpendicular to said cathode, and said means for introducing said coating material is located adjacent to said space region so as to enable introduction of said coating material directly into said primary plasma arc;

wherein said apparatus further comprises an auxiliary power source connected to said elongated tubular member for initiating an auxiliary spark discharge substantially between said cathode and said outlet orifice prior to initiation of the primary plasma arc for maintaining said auxiliary spark discharge.

13. An apparatus as defined in claim 12, wherein the diameter of the opening of said outlet orifice is chosen in a range of 0.5–5 mm so as to enable emerging of said fluid therefrom at a controllable rate of 0.1–10 l/min.

14. An apparatus as defined in claim 13, wherein said tubular member is electrically connected with an auxiliary power supply source so as to enable maintaining of the auxiliary spark discharge substantially between said cathode and said outlet orifice.

15. An apparatus as defined in claim 14, wherein said auxiliary power supply source is an autonomous source.

16. An apparatus as defined in claim 12, further comprising anode cooling means for cooling said anode.

17. An apparatus as defined in claim 12, further comprising anode displacement means for varying a location of said anode with respect to said primary plasma arc.

18. An apparatus as defined in claim 12, further comprising means for supplying a second fluid between said cathode and said anode.

19. An apparatus as defined in claim 18, wherein said means for supplying a second fluid comprises a hollow sleeve provided with a protection nozzle, said hollow sleeve surrounding at least part of an outwardly facing surface of said tubular member so as to be in coaxial disposition therewith and to provide a passage therebetween, wherein said sleeve has an inlet opening for communicating with a source of said second fluid and said nozzle is provided with an outlet opening so as to enable supply of said second fluid to said space region.

20. An apparatus as defined in claim 19, wherein said cathode, said anode, said main power supply source, said auxiliary power supply source, said tubular member, said hollow sleeve and said protecting nozzle constitute a setup of a commercially available plasma welding apparatus.

* * * * *